United States Patent [19]

Smith

[11] 4,134,496

[45] Jan. 16, 1979

[54] DEVICE FOR PROTECTING A CORNER OF AN ARTICLE

[75] Inventor: Richard A. Smith, St. Charles, Mo.

[73] Assignee: Container Corporation of America, Chicago, Ill.

[21] Appl. No.: 921,455

[22] Filed: Jul. 3, 1978

[51] Int. Cl.[2] ..... B65D 85/48; B65D 81/02

[52] U.S. Cl. ..... 206/453; 206/586; 229/34 HW; 229/DIG. 1

[58] Field of Search ..... 220/416, 445; 206/453, 206/454, 586; 229/34 HW, 36, DIG. 1

[56] References Cited

U.S. PATENT DOCUMENTS

| | | | |
|---|---|---|---|
| 3,822,036 | 7/1974 | Goodsite | 229/34 HW X |
| 4,000,843 | 1/1977 | Sorensen et al. | 229/DIG. 1 |

*Primary Examiner*—William T. Dixson, Jr.
*Assistant Examiner*—Allan N. Shoap
*Attorney, Agent, or Firm*—Carpenter & Ostis

[57] ABSTRACT

A device for protecting a corner of an article has a pair of main panels and a hollow internal member of substantial L-shape. The panels and the internal member are formed from a single blank of paperboard, or the like, and are interlocked to close the device.

5 Claims, 3 Drawing Figures

DEVICE FOR PROTECTING A CORNER OF AN ARTICLE

This invention relates to a device for protecting a corner of an article, such as a mirror, a sheet of glass, or the like, while the same is being shipped or stored.

SUMMARY OF THE INVENTION

The device has a pair of main panels arranged in spaced, parallel relationship. A hollow, L-shaped internal member is foldably attached to one of the main panels and is positioned between the main panels along two adjacent edges thereof.

DRAWING

Figure 1:
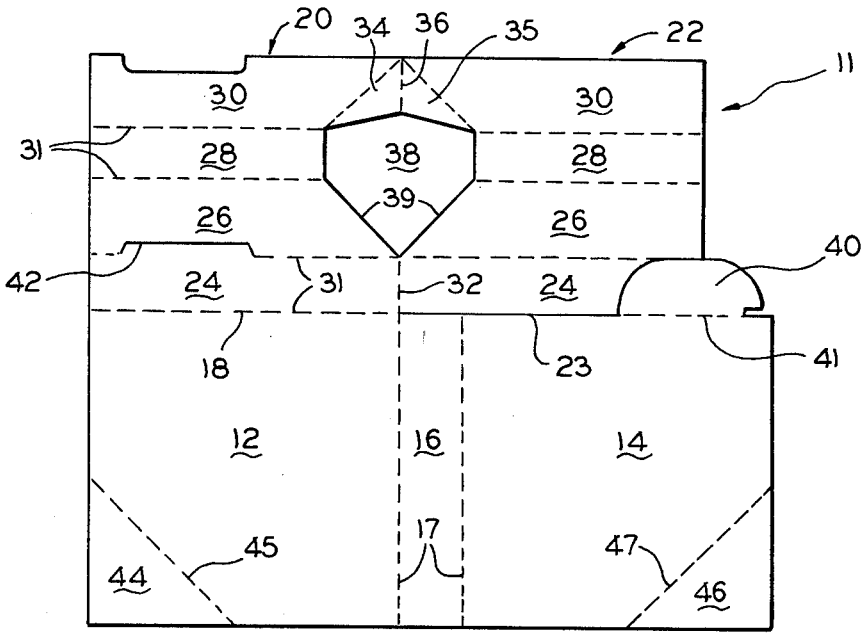
FIG. 1 is a plan view of a blank for forming the device of the present invention.
Figure 2:
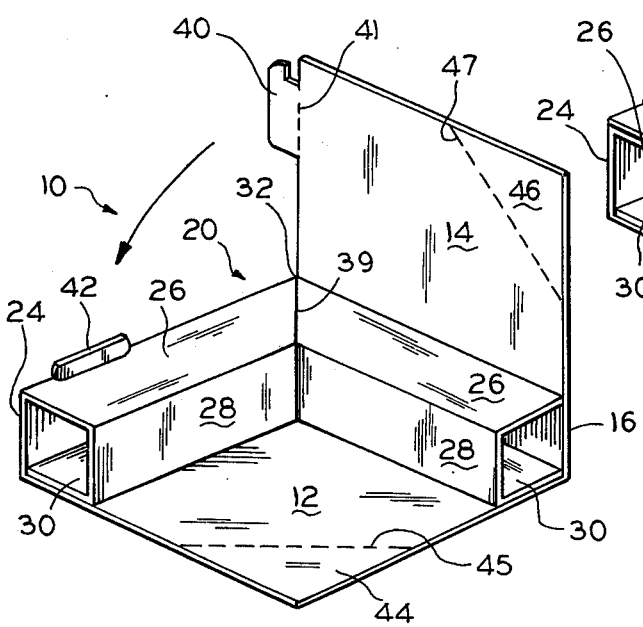
FIG. 2 is a perspective view of the device showing a top main panel in an open position.
Figure 3:
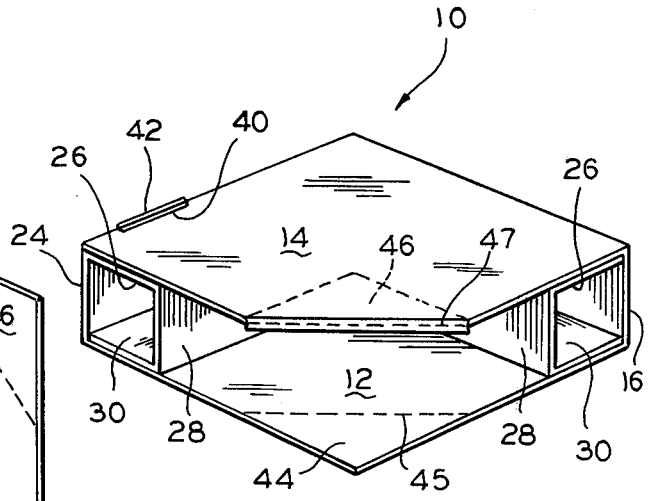
FIG. 3 is a perspective view of the device in a closed position.

Referring now to the drawing, a device 10, shown in FIGS. 2 and 3, is formed from a blank 11 of paperboard, or the like, illustrated in FIG. 1.

A pair of main panels 12 and 14 of similar size and configuration are arranged in parallel relationship and are foldably interconnected by an end panel 16 which is joined at its opposite edges to the adjacent edges of the respective main panels 12 and 14 by fold lines 17 and extends transversely between the panels.

A hollow, substantially L-shaped internal member is formed from the same blank 11 and is hinged to an edge of the main panel 12 along a fold line 18.

The internal member has first portion 20 and a second portion 22 which are similar in construction.

While the first portion 20 is hinged to the main panel 12 along the fold line 18, the second portion 22 is free of direct attachment to the main panel 14 as indicated by a cut line 23 which is a continuation of the fold line 18.

The first and second portions 20 and 22 have outer flaps 24, connecting flaps 26, inner flaps 28 and horizontal flaps 30 foldably interconnected along fold lines 31.

As best seen in FIG. 1, the flaps 30 of the first and second portions are foldably connected to one another along a hinge line 32 which is also a line of fold for folding the second portion 22 into right angles to the first portion 20 as best seen in FIG. 2.

The horizontal flaps 30 of the two portions are foldably connected by a gusset formed of a pair of triangular gusset elements 34 and 35 joined at a fold line 36.

To provide for proper folding of the second portion 22 against the first portion 20, the flaps 28 of both portions are made shorter than the remaining flaps and are spaced from each other by an aperture 38 which also separates the flaps 26 from one another providing the flaps with diagonal inner edges 39.

The main panel 14 has a locking tab 40 hinged thereto along a fold line 41. The tab is formed from material struck from the flap 24 of the second portion 22 of the internal member.

The first portion 20 of the internal member has a slot 42 for receiving the tab 40 and thereby securing the structure together.

The panel 12 has a triangular flap 44 hinged thereto at a fold line 45 while the panel 14 has a similar flap 46 hinged along a fold line 47. As best seen in FIG. 3, the flap 46 is folded inwardly to grasp a corner of an article to be placed between the panels 12 and 14 more tightly. If desired, the flap 44 can also be folded inwardly, or both flaps 44 and 46 may be retained in their unfolded positions.

I claim:

1. A device formed from a blank of paperboard or the like for protecting and cushioning a corner of an article, said device comprising:

(a) a pair of main panels of substantially similar size spaced from each other in parallel relationship;

(b) an end panel foldably joined at its opposite edges to corresponding edges of respective main panels and extending transversely therebetween;

(c) a hollow, substantially L-shaped internal member hinged to an edge of one of said main panels along a fold line disposed normal to said end panel;

(d) said internal member having first and second portions each including:

(i) inner and outer flaps foldably joined by a connecting flap positioned in parallel relationship to said main panels;

(ii) the outer flap of said first portion being foldably connected to the outer flap of said second portion along a hinge line;

(iii) said second portion being folded along said hinge line at right angles to said first portion and positioned in contacting engagement with said end panel.

2. The device as defined in claim 1, wherein one of said main panels has a locking tab, while said internal member has a slot for receiving said tab.

3. The device as defined in claim 1, wherein each of said first and second portions has a horizontal flap positioned in parallel relationship with said connecting flap and spaced therefrom by said inner and outer flaps.

4. The device as defined in claim 3, wherein the horizontal flap of said first portion is foldably attached to the horizontal flap of said second portion by a gusset.

5. The device as defined in claim 4, wherein said gusset is formed from a pair of connected triangular gusset elements.

* * * * *